US005363656A

United States Patent [19]

Nagamura et al.

[11] Patent Number: 5,363,656

[45] Date of Patent: Nov. 15, 1994

[54] ULTRA-HIGH PURITY NITROGEN AND OXYGEN GENERATOR

[75] Inventors: Takashi Nagamura; Takao Yamamoto, both of Hyogo, Japan

[73] Assignee: L'Air Liquide, Societe Anonyme Pour L'Etude et L'Exploitation Des Procedes Georges Claude, Paris, France

[21] Appl. No.: 157,035

[22] Filed: Dec. 2, 1993

[30] Foreign Application Priority Data

Apr. 13, 1992 [JP] Japan ..... 4-093045

[51] Int. Cl.[5] ..... F25J 3/02

[52] U.S. Cl. ..... 62/25; 62/39

[58] Field of Search ..... 62/24, 39, 25

[56] References Cited

U.S. PATENT DOCUMENTS

| | | | |
|---|---|---|---|
| 4,977,746 | 12/1990 | Grenier et al. | 62/24 |
| 5,019,145 | 5/1991 | Rohde | 62/22 |
| 5,069,699 | 12/1991 | Aerawal | 62/39 |
| 5,195,324 | 3/1993 | Cheung | 62/24 |
| 5,205,127 | 4/1993 | Agrawal | 62/24 |

FOREIGN PATENT DOCUMENTS

| | | |
|---|---|---|
| 0299364 | 1/1989 | European Pat. Off. . |
| 2640032 | 6/1990 | France . |
| 64-45290 | 9/1987 | Japan . |

*Primary Examiner*—Ronald C. Capossela

*Attorney, Agent, or Firm*—Curtis, Morris Safford

[57] ABSTRACT

A generator produces ultra-high purity nitrogen and ultra-high purity oxygen simultaneously by the liquefaction and rectification of feed air. Feed air is rectified in a first rectification column, and nitrogen gas separated to the top of that column is liquefied, in a nitrogen condenser, by oxygen-enriched liquid air separated to the bottom portion of the first rectification column. The oxygen-enriched liquid is fed to the upper portion of a second rectification column having a reboiler at its bottom, so that through rectification oxygen gas is fed from above a liquid reservoir to the lower portion of a third rectification column. Through rectification of the oxygen gas in the third rectification column, high purity oxygen gas, from which impurities having boiling points higher than that of oxygen have been removed by liquefaction, is fed to the center portion of a fourth rectification column which has a condenser in its top portion and a reboiler in its bottom portion. Through rectification of the high purity oxygen gas in the fourth rectification column, impurities having boiling points lower than that of oxygen are exhausted from the top portion thereof as non-condensed gas and ultra-high purity liquid oxygen is separated to the bottom thereof.

4 Claims, 1 Drawing Sheet

ULTRA-HIGH PURITY NITROGEN AND OXYGEN GENERATOR

Figure 1:
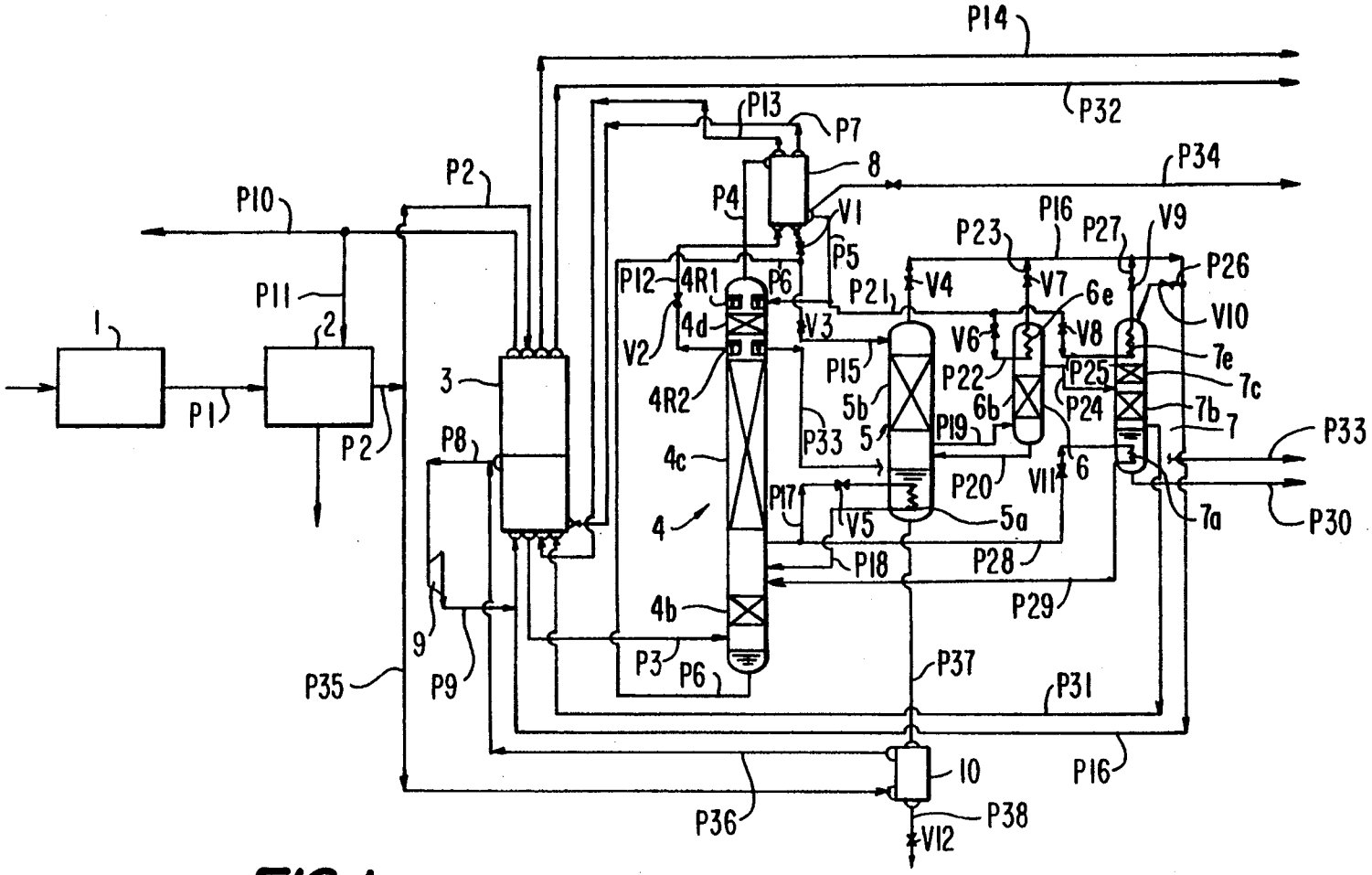

The present invention relates to an improvement in an ultra-high purity nitrogen generator (air separation unit) suitable for use in a semiconductor manufacturing factory or the like, by which ultra-high purity oxygen necessary for the manufacture of semiconductors or other purposes can be produced at the same time.

To generate ultra-high purity nitrogen a single air rectification column has been used as disclosed in the official gazette of Japanese Utility Model Application Laid-open No. 45,290/1989. If ultra-high purity oxygen is to be produced (with a purity of 99.9999%), however, a sufficiently high purity of oxygen cannot be obtained, even if a general air rectifying method and a purifying method such as adsorption are combined. Accordingly, other methods have been used such as electrolysis, which is high in cost.

One of the inventors has therefore proposed a method as disclosed in the official gazette of Japanese Patent Application Laid-open No. 282,683/1990, in which ultra-high purity oxygen is produced by using, as a feed material, liquid oxygen having a purity as high as 99.0–99.6%, produced by another air liquefaction-separation unit, and purifying this feed material through rectification.

However, if according to such methods ultra-high purity nitrogen and ultra-high purity oxygen are directly fed to a semiconductor manufacturing factory through pipelines, it is necessary to install two units for nitrogen and oxygen. To the oxygen unit, furthermore, liquid oxygen must be transported from another oxygen generating factory as a feed material.

The operation of these two units makes an economically large load, including a personnel expense, running cost and maintenance expense. Disadvantageously, the periodical supplement of liquid oxygen to the oxygen unit from another place requires not only a transportation cost but also a storage tank.

The present invention is intended to solve various disadvantages in the prior art such as those mentioned above and to provide both the products of ultra-high purity nitrogen and ultra-high purity oxygen preferably in the forms of liquid and gas.

According to the invention, there is provided a process for the production of ultra-high purity nitrogen and oxygen, in which compressed feed air left after removal of impurities therefrom is cooled down for liquefaction, and introduced to a lower portion of a first rectification column so that through its rectification in a rectifying portion of the first rectification column, ultra-high purity nitrogen is taken out of an upper portion of the first rectification column, and ultra-high purity oxygen is produced at the same time, characterized in that after oxygen-enriched liquid air taken out of the lower portion of the first rectification column is reduced in pressure, it is introduced to a second rectification column, so that through its rectification in a rectifying portion of the second rectification column, liquid oxygen is stored in a bottom portion of the second rectification column, the same liquid oxygen is warmed by a reboiler so as to be turned to oxygen gas containing a trace amount of impurities, the same oxygen gas is purified in a third rectification column wherein components in the oxygen gas, whose boiling points are higher than that of oxygen, are removed therefrom by liquefaction in the third rectification column, and the purified oxygen gas is thereafter introduced to a fourth rectification column, so that following rectification in a rectifying portion of the fourth rectification column, ultra-high purity oxygen is taken out from below a rectifying portion thereof.

According to a further aspect of the invention, there is provided an ultra-high purity nitrogen and oxygen generator comprising means for purifying and cooling compressed feed air, a first rectification column for rectification of said feed air introduced into a lower portion thereof, in a rectifying portion thereof to produce ultra-high purity nitrogen and means for simultaneously producing ultra-high purity oxygen characterized in that said means for producing ultra-high purity oxygen comprises second, third and fourth rectification columns, means for reducing the pressure of oxygen-enriched liquid air from the lower portion of the first column and introducing said reduced-pressure liquid air into the second column for rectification in a rectifying portion thereof to produce and store liquid oxygen in a bottom portion of the second column, a reboiler for vaporizing said liquid oxygen to form gaseous oxygen, means for introducing the gaseous oxygen into the third column for purification by liquefaction of impurities having a higher boiling point than that of oxygen, means for introducing said purified gaseous oxygen into the fourth column for rectification in a rectifying portion thereof and means for removing ultra-high purity oxygen from a region below a rectifying portion.

In the generator according to the present invention mentioned above, cooled and liquefied compressed feed air is rectified in the rectifying portion of a first rectification column at first so that an ultra-high purity nitrogen product is separated to the upper portion thereof and oxygen-enriched liquid air to the lower portion thereof, respectively, a portion of the oxygen-enriched liquid air is introduced into a second rectification column so that through its rectification, waste gas containing a large amount of nitrogen gas is separated to the top portion thereof and liquid oxygen to the bottom portion thereof, respectively, and this liquid oxygen is heated so as to be evaporated by a reboiler of the second rectification column.

The evaporated oxygen is introduced into a third rectification column, so that thorough its rectification, high purity oxygen gas is separated to above the rectifying portion thereof, and liquid oxygen to be returned to the second rectification column, which contains a trace amount of components having higher boiling points than that of oxygen such as hydrocarbons, krypton, xenon, carbon dioxide and moisture, to below the same rectifying portion, respectively.

The aforementioned high purity oxygen gas is introduced into a fourth rectification column so that through its rectification, a trace amount of components having lower boiling points than that of oxygen such as nitrogen, carbon monoxide and argon are separated to the top portion thereof and ultra-high purity liquid oxygen to the lower liquid reservoir thereof, respectively. This ultra-high purity liquid oxygen will be taken out as a product as it is in the liquid condition, or in the gaseous condition after heating.

Referring to the accompanying drawing, one embodiment of the ultra-high purity nitrogen and oxygen generator according to the present invention will be described below.

All the pressures mentioned below represent gauge pressures.

As shown in FIG. 1, feed air, from which dust has been removed by a filter, is compressed to about 8.7 kg/cm$^2$ by a compressor 1, and subjected to removal of carbon monoxide, hydrogen, moisture and carbon dioxide by means of a carbon monoxide & hydrogen convector and cooling, decarbonating and drying unit 2. Then, the major portion of the feed air is introduced at a temperature of about 20° C. through a pipe P2 into a heat exchanger 3, where it is cooled down to about −166° C. through a counter current indirect heat exchange with an ultra-high purity nitrogen gas product, a high purity oxygen gas product, oxygen-enriched air and the other waste gas, which will be mentioned hereinafter, and a portion thereof is liquefied, taken out through a pipe P3, and introduced to the lower portion of a first rectification column 4.

In the first rectification column 4, nitrogen gas separated to the top portion thereof through the rectification of the feed air in the rectifying portions **4*b*, 4*c*, and 4*d* thereof is introduced to a nitrogen condenser 8 via a pipe P4, where it is liquefied through an indirect heat exchange with oxygen-enriched liquid air, mentioned below, thereby providing high purity liquid nitrogen, and a non-condensed gas containing impurities having lower boiling points than that of nitrogen such a helium and neon is exhausted through a pipe P34. On the other hand, the major portion of the aforesaid liquid nitrogen is returned to a liquid reservoir 4R1 provided in the upper portion of the first rectification column 4 through a pipe P5**.

From the column bottom of the first rectification column 4, oxygen-enriched liquid air (about −172° C.) is taken out through a pipe P6, and reduced in pressure to about 4.2 kg/cm$^2$ by means of an expansion valve V1. Then, a portion of the oxygen-enriched liquid air reduced in pressure is introduced into the aforesaid nitrogen condenser 8 as a cold source. The oxygen-enriched liquid air evaporated in the nitrogen condenser 8 is turned to oxygen-enriched air of about −172° C. and taken out thereof through a pipe P7, and it cools down the feed air in the aforementioned heat exchanger 3 so at to be warmed to about −150° C.

Then, the warmed oxygen-enriched air is taken out of the middle portion of the heat exchange 3 through a pipe P8.

The cold gas taken out of the heat exchanger 3 is added to a cold gas coming from a pipe P36, which will be mentioned hereinafter, and both the cold gases are fed to an expansion turbine 9, where they are expanded up to about 0.3 kg/cm$^2$ so as to have a temperature of about −180° C.

After the expanded gas is removed therefrom through a pipe P9, it is added to a cold gas from a pipe P16, mentioned below, and both the cold gases are introduced to the heat exchanger 3 again, where they are used to cool down the feed air so as to be warmed to normal temperatures, and are removed through a pipe 10. The major portion of this removed gas is directly exhausted to the open air as waste gas, and a portion thereof is sent to the cooling, decarbonating and drying unit 2 via a pipe 11 as a regenerating gas, and then exhausted to the open air.

The high purity liquid nitrogen returned to the liquid reservoir 4R1 provided in the upper portion of the aforesaid first rectification column 4 is rectified while it flows down in the rectifying portion **4*d* thereof. As a result, the high purity liquid nitrogen is turned to ultra-high purity liquid nitrogen free from boiling point components, and it is taken out of a liquid reservoir 4R2 through a pipe P12. After the taken-out ultra-high purity liquid nitrogen is reduced in pressure to 7.5 kg/cm$^2$ by means of an expansion valve V2 and its temperature is further lowered, it is sent to the aforementioned nitrogen condenser 8**.

The ultra-high purity liquid nitrogen which has been used together with the said oxygen-enriched liquid air as a cold source in the nitrogen condenser 8, thereby cooling down and liquefying the aforesaid nitrogen gas, is evaporated by itself, taken out of the nitrogen condenser 8 through a pipe P13 so as to be sent to the heat exchanger 3. The evaporated liquid nitrogen sent to the heat exchanger 3 is warmed to normal temperatures while it cools down the feed air, and taken out thereof through a pipe P14 as an ultra-high purity nitrogen gas product. In addition, a liquid taken out of the liquid reservoir 4R2 through a pipe 33 will be utilized as an ultra-high purity liquid nitrogen product.

Although the oxygen-enriched liquid air taken out of the column bottom of the first rectification column 4 through the pipe P6 is expanded up to about 4.2 kg/cm$^2$ by means of the expansion valve V1, and sent to the nitrogen condenser 8, as mentioned above, the remaining part thereof is branched to a pipe P15, reduced in pressure to about 0.5 kg/cm$^2$ by means of an expansion valve V3, and then introduced to the upper portion of a second rectification column 5. This oxygen-enriched liquid air is rectified while it flows down in the rectifying portion **5*b* of the second rectification column 5. As a result, nitrogen and other components having lower boiling points than that of nitrogen are separated therefrom as non-condensed gas, exhausted out of the top portion of the second rectification column 5 through a pipe P16. The exhausted non-condensed gas is reduced in pressure to 0.3 kg/cm$^2$ by means of an expansion valve V4, and joined to a discharge pipe P9 of the aforementioned expansion turbine 9**.

The liquid oxygen which has rectified while it flows down in the rectifying portion **5*b* of the second rectification column 5 and stored in the bottom portion thereof, is warmed so as to be partially evaporated by a gas taken out between the rectifying portions 4*b* and 4*c* of the first rectification column 4 through a pipe P17 and introduced into a reboiler 5*a* disposed in the bottom portion of the second rectification column 5 through a valve 5. The evaporated liquid oxygen is then rectified while it rises in the rectifying portion 5*b* thereof. On the other hand, the gas introduced into the reboiler 5*a* is liquefied and then returned to the first rectification column 4 at a position below the aforementioned take-out pipe P17 thereof via a pipe P18**.

Between the liquid oxygen reservoir provided in the column bottom of the second rectification column 5 and the rectifying portion **5*b* thereof, oxygen gas is taken out through a pipe P19, and it is introduced to below the rectifying portion 6*b* of a third rectification column 6. This oxygen gas is rectified while it rises in the rectifying portion 6*b*. On the other hand, a portion of the aforesaid high purity liquid nitrogen taken out of the nitrogen condenser 8 through the pipe 5 is branched to a pipe P21, reduced in pressure by means of an expansion valve V6, and then sent to a condenser 6*e* provided in the top portion of the third rectification column 6 as a cold source through a pipe P22**.

This liquid nitrogen sent to the condenser **6*e* condenses and liquefies high purity oxygen gas rising in the rectifying portion 6b**, so that it is caused to flow down as reflux liquid.

Owing to the aforementioned rectification, the liquid oxygen containing a slight amount of impurities having higher boiling points than that of oxygen remains in the bottom portion of the third rectification column 6, and it is taken out through a pipe P20 and returned to below the aforesaid take-out pipe P19 of the second rectification column 5. On the other hand, the high purity liquid nitrogen used as a cold source for the top condenser 6e is evaporated and taken out through a pipe P23, and the taken-out liquid nitrogen is reduced in pressure to about 0.3 kg/cm$^2$ by means of an expansion valve V7, and then exhausted to a waste gas pipe P16.

From the third rectification column 6 between the rectifying portion 6b and top condenser 6e thereof, high purity oxygen gas free from impurities having higher boiling points than that of oxygen is taken out through a pipe 24, and introduced to the center portion of a fourth rectification column 7, this is a position between the rectifying portions 7b and 7c thereof. This high purity oxygen gas is rectified while it rises in the rectifying portion 7c. As a result, oxygen is liquefied by a top condenser 7e, mentioned below, and a trace amount of impurities having lower boiling points than that of oxygen are taken out of the column top of the fourth rectification column 7 as non-condensed gas through a pipe P26, reduced in pressure in pressure to about 0.3 kg/cm$^2$ by means of an expansion valve V10, and then exhausted into the waste gas pipe P16.

The high purity liquid oxygen liquefied in the top condenser 7e is rectified while it flows down in the rectifying portions 7c and 7b as a reflux liquid to the rectifying portions 7c and 7b, so that it is turned to ultra-high purity liquid oxygen free from impurities having lower boiling points than that of oxygen, and stored in the column bottom of the fourth rectification column 7 below the rectifying portion 7b thereof. In the liquid reservoir provided in the column bottom of the fourth rectification column 7 is disposed a reboiler 7a, mentioned below, through which a warming gas passes. By means of the reboiler 7a, the ultra-high purity liquid oxygen is warmed so as to be partially evaporated. Then, the evaporated gas is rectified while it rises in the rectifying portions 7b and 7c.

For a cold source necessary in the top condenser 7e of the fourth rectification column 7, the high purity liquid nitrogen introduced thereto from the pipe P21 via the expansion valve V8 and the pipe P25 is used similarly in the top condenser 6e of the third rectification column 6. This liquid nitrogen is evaporated by itself and taken out through a pipe 27, regulated in pressure by means of an expansion valve V9, and then exhausted into the waste gas pipe P16. On the other hand, the warming gas fed to the reboiler 7a provided in the column bottom is of gas which is taken out of the first rectification column 4 between the rectifying portions 4b and 4c thereof through the pipe 17, similarly to the warming gas for the reboiler 5a of the second rectification column 5, branched to a pipe P28, and introduced into the same reboiler 7a via a valve V11. This warming gas itself is then liquefied here and returned to the first rectification column 4 at a position below the aforementioned take-out pipe P17 thereof through a pipe P29.

The ultra-high purity liquid oxygen stored in the column bottom of the fourth rectification column 7, which is free from both impurities having higher boiling points and impurities having lower boiling points than that of oxygen, is taken out of the column bottom through a pipe P30 as an ultra-high purity liquid oxygen product, and further taken out of the gas phase above the reservoir thereof through a pipe P31 as ultra-high purity oxygen gas. This low temperature oxygen gas is introduced to the heat exchanger 3 via the pipe P31, where it is warmed to normal temperature through a counter current heat exchange with the feed air flowing thereunto from the pipe P3, and then it is taken out as an ultra-high purity oxygen gas product through a pipe P32.

Since there is a danger that hydrocarbons having higher boiling points than that of oxygen such as methane and acetylene, accumulated in the liquid oxygen stored in the column bottom of the second rectification column 5, may explode through a reaction with oxygen, a portion of the liquid oxygen is extracted from the column bottom through a pipe P37, and it is evaporated, in an auxiliary heat exchanger 10, through a counter current heat exchange with the feed air introduced therein through a pipe P35 branched from the pipe P2, and then exhausted to the open air via a pipe P38 and a pressure regulation valve V12. The air as a warming source here is cooled down, taken out through a pipe P36, joined to the pipe P8, and sent to the expansion turbine 9.

The ultra-high purity nitrogen and oxygen generator according to the present invention can give the following effects inherent in the present invention because it is constructed as mentioned above and has functions accompanied with the aforementioned construction.

In the first rectification column, ultra-high purity nitrogen free from impurities having higher boiling points and impurities having lower boiling points than that of nitrogen can be obtained by taking out liquid nitrogen from slightly below the column top portion thereof, to which the high purity liquid nitrogen is returned from the nitrogen condenser.

The oxygen-enriched liquid air separated to the column bottom of the first rectification column is rectified in the second rectification column so as to be separated to the column bottom thereof as liquid oxygen whose oxygen concentration is further increased, and to the third rectification column, this liquid oxygen is not fed as it is, but the evaporated gas thereof is fed. Accordingly, impurities having higher boiling points than that of oxygen, contained in the liquid oxygen, are merely accompanied in a slight amount to the third rectification column. From the column top of the second rectification column, in addition, nitrogen and also impurities having lower boiling points than that of nitrogen are exhausted.

From the third rectification column to the fourth rectification column is fed the high purity oxygen gas taken out from above the rectifying portion thereof, not liquid oxygen. Accordingly, this light purity oxygen gas is free from high boiling point impurities, and through its rectification in the fourth rectification column, ultra-high purity liquid oxygen, from which low boiling point impurities have been also removed, can be separated to the column bottom thereof.

Owing to the aforementioned construction, ultra-high purity nitrogen and ultra-high purity oxygen can be produced from one unit only by carrying out the liquefaction and rectification of feed air, without requiring another purification apparatus.

We claim:

1. Process for the production of ultra-high purity nitrogen and oxygen, in which compressed feed air left after removal of impurities therefrom is cooled down for liquefaction, and introduced to a lower portion of a first rectification column (4), so that through its rectification in a rectifying portion (4*b*, 4*c*, 4*d*) of the first rectification column, ultra-high purity nitrogen is taken out of an upper portion of the first rectification column (4), and ultra-high purity oxygen is produced at the same time, characterized in that after oxygen-enriched liquid air taken out of the lower portion of the first rectification column (4) is reduced in pressure, it is introduced to a second rectification column (5), so that through its rectification in a rectifying portion (5*b*) of the second rectification column, liquid oxygen is collected in a bottom portion of the second rectification column (5), the same liquid oxygen is warmed by a reboiler (5*a*) so as to be turned to oxygen gas containing a trace amount of impurities, the same oxygen gas is purified in a third rectification column (6) wherein components in the oxygen gas, whose boiling points are higher than that of oxygen, are removed therefrom by liquefaction in the third rectification column, and the purified oxygen gas is thereafter introduced to a fourth rectification column (7), so that following rectification in a rectifying portion (7*b*, 7*c*) of the fourth rectification column, ultra-high purity oxygen is taken out from below a rectifying portion thereof.

2. Process according to claim 1 wherein part of the oxygen enriched liquid air from the first column (4) is evaporated and is used to cool the feed air prior to liquefaction in a heat exchanger (3).

3. Process according to claim 1 wherein part of the liquid oxygen stored in the second column (5) is evaporated by heat exchange with the feed air in a heat exchanger (3) so as to cool the feed air prior to liquefaction.

4. An ultra-high purity nitrogen and oxygen generator comprising means for purifying and cooling compressed feed air, a first rectification column (4) for rectification of said feed air introduced into a lower portion thereof, in a rectifying portion (4*b*, 4*c*, 4*d*) thereof to produce ultra-high purity nitrogen and means for simultaneously producing ultra-high purity oxygen characterized in that said means for producing ultra-high purity oxygen comprises second, third and fourth rectification columns (5, 6, 7), means (V3) for reducing the pressure of oxygen-enriched liquid air from the lower portion of the first column (4) and introducing said reduced-pressure liquid air into the second column (5) for rectification in a rectifying portion (5*b*) thereof to produce and collect liquid oxygen in a bottom portion of the second column (5), a reboiler (5*a*) for vaporizing said liquid oxygen to form gaseous oxygen, means for introducing the gaseous oxygen into the third column (6) for purification by liquefaction of impurities having a higher boiling point than that of oxygen, means for introducing said purified gaseous oxygen into the fourth column (7) for rectification in a rectifying portion (7*b*, 7*c*) thereof and means for removing ultra-high purity oxygen from a region below a rectifying portion (7*b*, 7*c*).

* * * * *